US010577806B2

(12) United States Patent
Wiegrink

(10) Patent No.: US 10,577,806 B2
(45) Date of Patent: Mar. 3, 2020

(54) JOINT FILLING PROFILE

(71) Applicant: SK Wiegrink Beteiligungs GmbH, Bocholt (DE)

(72) Inventor: Stefan Wiegrink, Bocholt (DE)

(73) Assignee: SK WIEGRINK BETEILIGUNGS GMBH, Bocholt (DE)

( * ) Notice: Subject to any disclaimer, the term of this patent is extended or adjusted under 35 U.S.C. 154(b) by 0 days.

(21) Appl. No.: 15/589,128

(22) Filed: May 8, 2017

(65) Prior Publication Data

US 2017/0321432 A1 Nov. 9, 2017

(30) Foreign Application Priority Data

May 6, 2016 (DE) ..... 20 2016 102 430 U

(51) Int. Cl.
*E04F 15/02* (2006.01)
*E04B 1/68* (2006.01)
*E04F 15/14* (2006.01)

(52) U.S. Cl.
CPC ..... *E04F 15/02016* (2013.01); *E04B 1/6804* (2013.01); *E04F 15/02033* (2013.01); *E04F 15/14* (2013.01)

(58) Field of Classification Search
CPC ..... E04F 15/02016; E04F 15/14; E04F 15/02033; E04B 1/6804; E01C 11/02
USPC ..... 52/513
See application file for complete search history.

(56) References Cited

U.S. PATENT DOCUMENTS 2,885,939 A * 5/1959 Bormolini ..... E01C 11/126 404/63
3,542,375 A * 11/1970 Renwick ..... B29C 65/3424 277/646
3,720,474 A * 3/1973 Krefter et al. ..... E01D 19/06 404/47
3,822,428 A * 7/1974 Stog ..... E01D 19/06 14/73.1
3,849,958 A * 11/1974 Balzer ..... E04B 1/6804 52/396.05
3,880,539 A * 4/1975 Brown ..... E01D 19/06 14/73.1
4,169,688 A * 10/1979 Toshio ..... E01C 5/005 404/40
4,362,430 A * 12/1982 Ceintrey ..... C04B 26/16 404/68
4,637,085 A * 1/1987 Hartkorn ..... E01D 19/06 14/73.1

(Continued)

FOREIGN PATENT DOCUMENTS

AU 2007201116 A1 4/2008
DE 1017198 B 10/1957

(Continued)

*Primary Examiner* — Patrick J Maestri
*Assistant Examiner* — Joseph J. Sadlon
(74) *Attorney, Agent, or Firm* — Harness, Dickey & Pierce, P.L.C.

(57) ABSTRACT

The invention relates to a joint filling profile for forming a joint sealing between floor panels (3, 4), with a vertical leg (6) that projects into the joint (2) and a profile body (7) formed from a joint sealing compound (9) and situated in a joint enlargement (5), whereby the vertical leg (6) and the profile body (7) are separated from each other by intercalating a separating material (8).

19 Claims, 3 Drawing Sheets

(56) References Cited

U.S. PATENT DOCUMENTS 4,824,283 A * 4/1989 Belangie ..... E01C 11/10 404/64
5,024,554 A * 6/1991 Benneyworth ..... E01D 19/06 404/47
5,082,394 A 1/1992 George
5,088,256 A * 2/1992 Face, Jr. ..... E01C 11/123 404/64
5,171,100 A * 12/1992 Bergstedt ..... E01C 11/106 403/225
5,513,927 A * 5/1996 Baker ..... E01D 19/06 404/47
5,584,152 A * 12/1996 Baerveldt ..... B29C 47/0019 404/67
5,718,093 A * 2/1998 Tanaka ..... E04C 2/34 52/471
5,797,231 A * 8/1998 Kramer ..... E04B 1/483 404/52
6,039,503 A * 3/2000 Cathey ..... E01C 11/10 14/73.1
6,101,776 A * 8/2000 Conley ..... E04F 15/14 219/213
6,401,416 B1 * 6/2002 Ytterberg ..... E04B 1/6801 52/396.02
6,591,567 B2 * 7/2003 Hota ..... B29C 65/342 14/13
6,619,879 B1 * 9/2003 Scuero ..... E04B 1/6809 404/74
6,751,918 B2 * 6/2004 Jesko ..... E01C 11/106 52/393
7,503,723 B2 * 3/2009 Nunn ..... B29B 17/0042 404/32
8,221,030 B1 * 7/2012 Haydu ..... E03B 11/00 405/70
8,397,453 B2 * 3/2013 Shaw ..... E04B 1/948 52/232
8,627,626 B2 * 1/2014 Boxall ..... E04B 1/483 404/57
8,828,892 B2 * 9/2014 Dong ..... B32B 5/26 442/20
8,887,463 B2 * 11/2014 Derrigan ..... E02D 17/10 404/25
9,091,058 B2 * 7/2015 Kempenaers ..... E04B 1/6807
9,115,504 B2 * 8/2015 Wallance ..... E04B 1/003
9,359,761 B2 * 6/2016 Scurto ..... E04B 5/32
9,404,581 B1 * 8/2016 Robinson ..... F16J 15/104
9,988,814 B2 * 6/2018 Schluter ..... E04B 1/625
10,052,506 B2 * 8/2018 Shaw ..... A62C 2/06
2005/0102941 A1 * 5/2005 Barr ..... E04B 1/6804 52/459
2008/0029490 A1 * 2/2008 Martin, Jr. ..... B29C 65/04 219/117.1
2014/0154008 A1 * 6/2014 Stachowicz ..... E01C 11/02 404/47
2017/0023192 A1 * 1/2017 Moita ..... F21V 31/03

FOREIGN PATENT DOCUMENTS

DE 56612 A1 6/1967
DE 2904236 A1 * 8/1980 ..... E04F 15/14
DE 10002866 A1 * 8/2001 ..... E04B 1/6801
DE 10002866 B4 2/2008
DE 102015118223 A1 4/2017
EP 0445341 A1 9/1991
EP 2098651 A2 9/2009
FR 2308747 A1 * 11/1976 ..... E01D 19/06
GB 2411196 A * 8/2005 ..... E01C 7/147
WO WO-2007053119 A1 5/2007

* cited by examiner

JOINT FILLING PROFILE

FIELD

The invention relates to a joint filling profile for forming a joint sealing between floor panels with a vertical leg that projects into the joint and a profile body formed from a joint sealing compound and situated in a joint enlargement.

BACKGROUND

Joint filling profiles for forming a joint sealing are known per se from the state of the art. Thus, the documents DE 100 02 866 B4 as well as EP 2 098 651 A2 disclose, for example, joint filling profiles of the generic kind.

Typically, the joint provided between two floor panels is sealed by means of a so-called joint filling. This can simply take place in that the joint is filled with a joint sealing compound. But so simply formed joint filling profiles have the disadvantage of an only limited lifetime, in particular when they are exposed to corresponding stresses as it is often the case in the field of industrial applications.

In order to make available a joint filling profile that also meets higher stresses and that is even appropriate for air technical applications, the document DE 100 02 866 B4 proposes a construction according to which a joint enlargement substantially extending in the horizontal direction is carried out on the free upper edges pointing to each other, whereby the joint is filled with a joint sealing compound reaching into the joint enlargement so as to be flush with the surface. This being, vertical indentations are formed in the upper edge area of the joint enlargement into which the profile body formed from the joint sealing compound engages.

The joint filling profile previously known from DE 100 02 866 B4 has proved successful in everyday practical applications. With respect to some applications, it however became evident that, because of the direct connection between the joint sealing compound and the floor panels, it can come to undesired tearing-off of the joint filling profile from the floor panels. This being, this problem occurs more often in case of corresponding mechanical and/or thermal stresses and is all the more serious when the constructional design of the joint width or of the joint enlargement is bigger.

In order to avoid undesired detachment phenomena of the joint sealing compound from the floor panels, the EP 2 098 651 A1 proposes that a portion in which there is no direct connection of the joint sealing compound with the floor panels is provided on each of the two floor panels. According to this construction, each floor panel makes available an area in the vicinity of the vertical leg of the joint filling profile that is chemically and/or mechanically outfitted in such a manner that the joint sealing compound introduced in the joint and in the joint enlargement has no direct connection in this area with the floor panel. It is advantageously achieved in that the joint filling profile has an increased ductility without the risk of being detached from the underground since an expansion of the material forming the joint sealing compound is allowed in the areas in which there is no direct connection between the joint sealing compound on the hand and the floor panels on the other hand since the material is only stretched in these areas without being hindered by adhering to the underground. Insofar joint filling profiles according to EP 2 098 651 A2 can resist to higher mechanical and/or thermal stresses and this with a considerably reduced risk of an undesired detachment from the underground.

Although the joint filling profile previously known from the document EP 2 098 651 A2 already brought out a considerable improvement, this construction is also not free of disadvantages. For example, it turned out to be a problem that the different material thicknesses in the area of the vertical leg on the one hand and of the profile body on the other hand can lead to the fact that, in case of corresponding expansion movements, it comes to crack formations in the transition area between the vertical leg and the profile body. Such crack formations can again result in that it comes to undesired detachment phenomena of the joint filling profile from the underground. Moreover, practice has shown that it can come in stress situations in the areas adjacent to the vertical leg, in which there is no direct connection between the joint sealing compound and the floor panels, to the formation of lens-shaped indentations, this because an expansion of the material is allowed in these areas because of the lacking connection with the underground whereas it is however not allowed in the adjacent areas. Thus, a non-uniform stress of the joint filling profile takes place that also negatively impacts the lifetime of the whole construction.

Starting from the explanations above, the aim of the invention is to further develop a joint filling profile of the generic type in such a manner that it helps avoiding undesired detachment phenomena due to the construction and that better resists to higher stresses with a simultaneously increased lifetime.

For achieving this aim, the invention provides a joint filling profile that is characterized in that the vertical leg and the profile body are separated from each other by intercalating a separating material.

In complete rejection of the previously known state of the art, the joint filling profile formed by the vertical leg and the profile body is no longer formed in one piece. On the contrary, the invention suggests to separate the vertical leg from the profile body, namely in that the vertical leg and the profile body are separated from each other by intercalating a separating material.

According to the constructions previously known from the state of the art, the joint and the joint enlargement are filled with a sealing compound for what purpose the joint is filled with the joint casting compound flush with the surface into the joint enlargement. In this manner, there results according to the state of the art a joint filling profile that has a vertical leg that projects into the joint and a profile body formed in one piece herewith and placed in the joint enlargement.

In contrast, this invention proposes to form the joint filling profile in that first the joint is filled so that the vertical leg of the later joint filling profile is created. Thus, the filling into the joint enlargement does not take place.

The thus formed vertical leg is then provided with a separating material on its upper side turned to the joint enlargement. This can take place mechanically or chemically, whereby the forming of a mechanical separation by bringing-in an intermediate layer is preferred. For example, a metal foil, in particular an aluminum foil can serve as a mechanical separating layer, which implies the advantage that there are no thermal limitations with respect to the implementation and to the treatment of corresponding joint sealing compounds.

The profile body is then formed from a sealing compound, whereby the profile body is separated from the vertical leg because of the previously applied separating material. Consequently, after the formation of the joint filling profile there is no direct connection between the vertical leg and the profile body.

The separation according to the invention of the vertical leg from the profile body has the essential advantage that undesired crack formations are also avoided in the transition area between the vertical leg and the profile body since, because they are not in one piece, there is no formation of different material thicknesses so that a different expansion because of different material thicknesses is avoided. Undesired detachment phenomena, in particular tearing-off of flanks, can still more effectively be avoided so that there results an increased lifetime.

According to a further characteristic of the invention, the profile body is situated in a first portion adjacent to the joint by intercalating a separation material on the corresponding floor panel without any connection. According to this further development, thus not only there is no direct connection between the profile body and the vertical leg but also between the profile body and the corresponding floor panel, namely in a first portion of the profile body that is formed adjacent to the joint. Consequently, it is thus provided that the profile body has no direct connection with the underground, namely in a portion that extends over a first portion of the first bottom panel, the vertical leg and a further first portion with respect to the other bottom plate. This configuration advantageously allows the joint filling profile to be able to provide ductility for compensating mechanical and/or thermal stresses, whereby the risk of tearing-off and/or of detachment does not exist because of the lacking direct connection with the profile body underground in the area described above. This being, in particular the lacking one-piece configuration of the profile body and of the vertical leg takes effect since the profile body can stretch out independently from the vertical leg as well in the horizontal as also in the vertical direction and the vertical leg does thus not impair the expansion ability. The lens effects disadvantageously appearing in constructions previously known from the state of the art, i.e. through constrictions due to expansion, can thus be reduced or even avoided. Moreover, the risk is averted that it comes in said area to the detachment of the profile body from the corresponding floor panels and/or from the vertical leg.

According to a further characteristic of the invention, it is provided that the profile body has a first vertical web penetrating into a groove of the corresponding floor panel in a second portion adjacent to the first portion. Accordingly, a second portion follows the first portion of the profile body on the outside. The profile body is in direct connection with the corresponding floor panel inside this second portion, whereby it is provided for fixing the profile body in the corresponding floor panel that the floor panel is provided with a groove extending in longitudinal direction of the joint, groove into which a vertical web provided by the profile body engages. Thus, a profile body is proposed that does not have any direct connection with the underground in the area of the joint as well as in the area of the first portion and that has a direct connection in the area of the second portion.

According to a further characteristic of the invention, it is provided that the profile body has a second vertical web spaced from the first vertical web in the second portion, this second vertical web penetrating into a groove of the corresponding floor panel. According to this further development, the second portion has two vertical webs. Both vertical webs preferably limit the second portion, i.e. the second portion extends from the first vertical web to the second vertical web. In fully mounted condition, both vertical webs engage respectively into a corresponding groove of the corresponding floor panel so that a close and direct connection is formed between the profile body and the corresponding floor panel in the area of the second portion.

According to a further characteristic of the invention, it is provided that a multitude of reinforcements that are placed the one after the other in the longitudinal direction of the joint are embedded into the profile body. The sense and purpose of the reinforcements is to avoid, in case of expansion, that the profile body bulges in and out in the area in which there is no direct connection with the underground. The reinforcement consequently ensures that the profile body terminates substantially in a parallel plane with the adjacent floor panels in spite of the above-described ductility.

According to a further characteristic of the invention, it is provided that the reinforcement has a guiding body on the one hand as well as a reinforcing element on the other hand, whereby the reinforcing element is configured relatively slidable with respect to the guiding body. In fully mounted condition, the guiding body accommodates the reinforcing element so that no direct connection is formed between the joint sealing compound of the profile body with the reinforcing element. Thus, the reinforcing element does not impede the ductility of the profile body. Because of the relative slidability of the reinforcing element with respect to the guiding body, it is rather possible that the reinforcing element takes part in the movements of the profile body. The guiding body is meanwhile also ductile so that it does not impede an expansion movement of the profile body either.

According to a further characteristic of the invention, the guiding body is a bush and for the reinforcing element the matter can be, for example, of a rod, in particular of a metal rod. In fully mounted condition, it is provided that the rod is accommodated by being longitudinally displaceable by the bush, whereby the bush has a longitudinal extension that exceeds the longitudinal extension of the rod. It is thus ensured that, in case of the expansion of the profile body, the rod can move accordingly inside the bush and its movement is not limited, for example, by the bush. Owing to the fact that the bush is configured longer in longitudinal direction than the rod, the rod can migrate inside the bush in case of expansion so that the rod that serves as a reinforcing element does not block the expansion movement of the profile body.

According to a further characteristic of the invention, it is provided that the reinforcement bears on the floor panels by intercalating a spacer. This being, the spacer serves the purpose of aligning the reinforcement in an accurate position before the joint enlargement is filled with the joint sealing compound for forming the profile body.

According to a further characteristic of the invention, the profile body is preferably configured axially symmetric and has two first portions adjacent to the joint that are followed respectively by a second portion. This being, there is no direct connection between the profile body and the underground in the area of the joint and of the two first portions. Such a direct connection is formed in the external second portions.

Accordingly, according to a further characteristic of the invention it is provided that the separating material extends in the area of the joint and of the two first portions adjacent hereto. Thus, a continuous area is created that extends starting from the first portion of the first floor panel over the joint into the first portion of the second floor panel in which there is no direct connection of the profile body with the underground.

According to a further characteristic of the invention, the reinforcement is configured in such a manner that it extends into the second portions. Thus, the reinforcement spans the area of the profile body in which there is no direct connection with the underground, whereby the reinforcement penetrates on the one end side into the second portion of the first floor panel and on the other end side into the second portion of the other floor panel. Insofar, a connection of the two second portions reaching over the first portions and the joint is created.

According to a further characteristic of the invention, it is provided that the vertical leg and/or the profile body is/are configured temperature-resistant at least in portions up to a temperature of 60° C., preferably up to a temperature of 70° C., even more preferably up to a temperature of 80° C.

According to this proposal, the joint filling profile is configured temperature-resistant at least in portions. Thus, the joint filling profile is appropriate to be also installed in areas that are exposed to higher temperatures according to the purpose thereof. In this context, mention can be made in particular of floor areas of industrial plants that are intended for the installation of heat emitting machines, furnaces and/or the like.

In this context, according to a further characteristic of the invention, it is provided that the sealing compound forming the vertical leg and/or the profile body is made of a thermostable material up to 60° C., preferably up to 70° C., even more preferably up to 80° C. In this context, a thermostable synthetic material is preferably used that is introduced in liquid state into the joint and/or into the joint enlargement and that is thermostable after curing up to said temperatures. It can alternatively be provided to form the vertical leg and/or the profile body from a non-thermostable material and to provide a coating covering the profile body on the upper side that is configured thermostable up to said temperatures. It can also be provided to form the vertical leg and the profile body from different materials, for example the vertical leg from a non-thermostable material and the profile body from a thermostable material.

According to a further alternative, it can be provided that a granulate made of a thermostable material is added to the sealing compound. For such a granulate, the matter can be, for example, of stone materials and/or of graphite.

According to a further characteristic of the invention, it is provided that the sealing compound forming the vertical leg and/or the profile body has particles that change their color as a result of physical and/or chemical influences.

The change of color of the particles advantageously serves the purpose of the user to be able to carry out a visual inspection of the joint filling profile configured according to the invention. Physical and/or chemical influence factors that can result in a change of color of the particles added to the sealing compound are, for example, mechanical pressurizations, ageing processes, effects of chemical substances such as, for example, acid and/or the like. It is particularly preferred to add particles to the sealing compound that change color over time, i.e. over the operating life of the joint filling profile according to the invention. The user can easily establish that the lifetime of the joint filling profile that is guaranteed by the manufacturer is achieved, for what reason it has to be replaced for ensuring the functional safety thereof. A change of color as a result of too high mechanical stresses is also advantageous since it can come to an irreversible deformation of the joint filling profile as a result of too high compressive stresses. The actually desired functional safety can then possibly no longer be available which is visually indicated to the user by a change of color of the joint filling profile. The same shall apply to the chemical substance. They can also result in a damaging of the joint filling profile, for what reason it is advantageous that it can be indicated to a user by a color of change that the joint filling profile is exposed to corresponding chemical substances such as, for example, acids.

According to a further characteristic of the invention, it is provided that a signal line is embedded in the profile body and/or the vertical leg. The matter can be, for such a signal line, of a fiber optic cable or of a current-carrying conductor.

Such a signal line proves to be advantageous for several reasons. It can be used, for example, as means for counting overruns. This can, for example, take place in that a signal that changes as a consequence of a compressive stress, i.e. in case of an overrun, is continuously applied to the signal line. This signal change is detected by means of a corresponding receiving unit. The number of overruns can be determined in this way, whereby it is preferably provided that, when a number of overruns that can be predetermined are reached, an indication occurs that indicates to the user that a number of overruns that is, for example, guaranteed by the manufacturer is reached.

The signal line can advantageously be also used as a warning for cracks. Because, in case of crack formations, it comes to an uncovering of the signal line and/or to a destruction thereof. This can be detected and indicated to the user accordingly. In order to make possible a warning of cracks as effective as possible, a multitude of signal lines are used, also configured as a signal line mat. Such a mat can simultaneously also serve as a separating material in the sense already explained above.

According to a further characteristic of the invention, a humidity sensor is provided. Such a humidity sensor can be embedded in the sealing compound of the joint filling profile and/or be inserted into the joint and/or the joint enlargement before forming the vertical leg and/or the profile body. This being, the humidity sensor serves in particular to detect water that has penetrated in the joint filling profile so that, in case water is detected, a corresponding output to the user can occur. Fundamentally, the joint filling profile configured according to the invention is configured waterproof and is applied to the corresponding floor panels by being waterproof. In case the humidity sensor reacts, it is thus means that the joint filling profile is destroyed at least in portions and/or that there is formation of cracks through which water penetrated. The humidity sensor thus serves to be able to early detect possible damages of the joint filling profile.

According to a further characteristic of the invention, a light strip is provided that is embedded in the joint filling profile. Such a light strip serves in particular in emergency conditions to make available guidance and/or escape exits. In this context, it is preferably provided to connect the light strip to a corresponding emergency system so that an initial operation of the light strip takes place actually only in case of an emergency situation.

According to a further characteristic of the invention, the joint filling profile is characterized by an embedded, fire retardant, heat insulating active substance and/or under exposure to heat a means, for example an active substance that delivers a cooling agent.

Appropriate mortars, stone materials and/or the like can form a fire-retardant active substance, for example. Mineral fibers, rock wool or the like can be provided as heat insulating active substances. An active substance that delivers a means under exposure to heat can be in particular a material foaming under heat exposure or a hydrate that delivers water when exposed to heat. Alternatively, an active substance that swells when exposed to heat can alternatively be provided.

The embedding of an active substance of the aforesaid type is provided in particular for such joint filling profiles that are formed below room terminations such as, for example, doors or portals. This being, in particular active substances that swell when exposed to heat are to be preferred since it is then ensured that, in the purposeful case of use, the gap provided between the room termination and the joint filling profile is filled by being swollen. There is thus not only a protection against flashover but also against undesired spread of smoke.

Moreover, the advantage of an active substance swelling when exposed to heat is that a liquid containment volume is formed, namely in that the swollen joint filling profile constitutes a barrier for escaped liquids, either for protecting against flowing into a room or before flowing out of a room.

According to a further characteristic of the invention, it is provided that an active substance of the aforesaid type is a constituent of a strip or string element. Such an element can be, in case of implementation, simply embedded in the joint filling profile. This being, it is preferred to embed such a strip element into the profile body, i.e. as close to the surface as possible. If the matter is, for the active substance, of an active substance that swells when exposed to heat, the joint filling profile tears up and a barrier extending in accordance to the routing path of the strip or string element is formed above the joint filling profile.

The above-described embodiments relate to respectively protectable inventions; they are thus independent from the fact that the vertical leg and the profile body are separated from each other by intercalating a separating material. Because it is obvious that a reinforcement, a fiber optic cable, a firebreak or fire control strings and/or the like can be provided even without such a separation. The same applies to a temperature-resistant configuration, either through an adequately formed sealing compound and/or providing of a corresponding covering layer.

SUMMARY

Furthermore, the invention proposes a method for producing a joint sealing between floor panels for which a substantially horizontally extending joint enlargement is implemented at the free upper edges pointing towards each other of adjacent floor panels for which the joint is filled so as to be flush with the surface of the ground of the joint enlargement, for which the material filling the joint is provided on the upper side with a separating material and for which the joint enlargement is filled with a joint sealing compound so as to be flush with the surface of the floor panels.

Moreover, it is provided that the ground of the joint enlargement is provided with a separating material in a portion adjacent to the joint.

Moreover, it is provided that reinforcement is brought into the joint enlargement.

The result of the implementation of the above described method is a joint filling profile of the aforesaid type wherewith the advantages described above are achieved.

FIGURES

Further characteristics and advantages of the invention result from the following description with reference to the figures.

Figure 3:
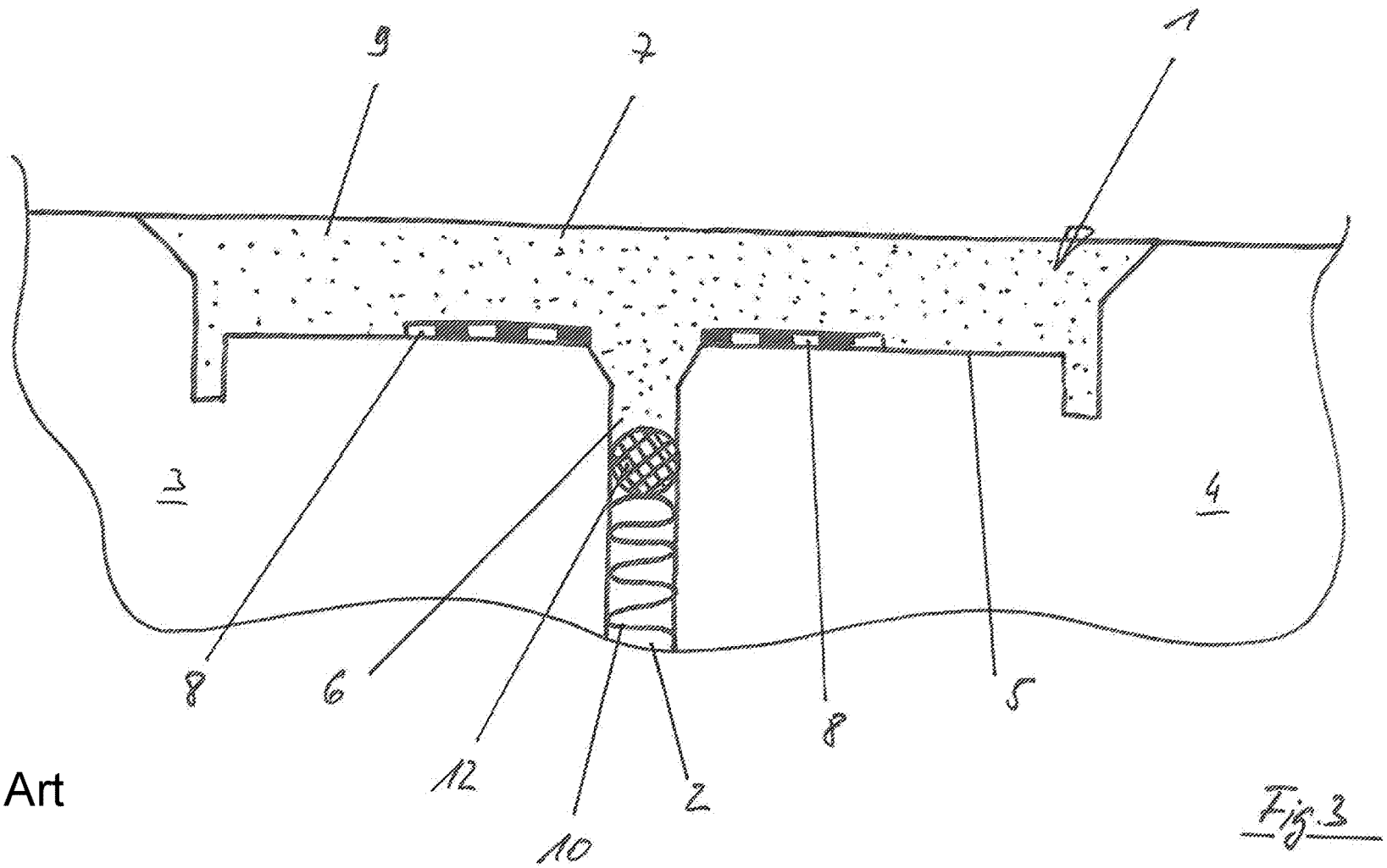
Fig. 3 Prior Art
FIG. 3 shows a schematic sectional view of a joint filling profile according to the state of the art.

From FIG. 3, a joint filling profile according to the state of the art according to EP 2 098 65 A2 can be recognized in a schematic sectional view.

DESCRIPTION

As can be seen from FIG. 3, a joint 2 is left between two adjacent floor panels 3 and 4, for example an expansion joint. This usually results from building regulations or from other imperatives. A filling material 10, for example a foam inlay, as well as a round cord 12 is placed in a manner known per se in the area of the joint 2 in order to avoid a three-point adhesion. Otherwise the joint sealing compound would connect as well the floor panels 3 and 4 as the underlying ground with each other.

A substantially horizontally extending joint enlargement 5 is formed in the area of the free upper edges pointing towards each other of the floor panels 3 and 4, this enlargement forming rectangular grooves on the outside that extend substantially parallel to the joint 2.

For forming the joint filling profile 1, the joint 2 is filled with a joint sealing compound 9 so as to be flush with the surface into the joint enlargement 5. In this manner, a joint filling profile is formed that has a profile body 7 and a vertical leg 6 formed in one piece therewith, which vertical leg 6 penetrates into the joint 2.

As can also be seen from FIG. 3, both floor panels 3 and 4 have respectively an area respectively adjacent to the joint 2 that is provided with a separating material 8. These areas are referred to as free areas in which due to the provided separating material 8 there is no direct connection between the joint sealing compound 9 and the floor panels 3 and 4.

Figure 1:
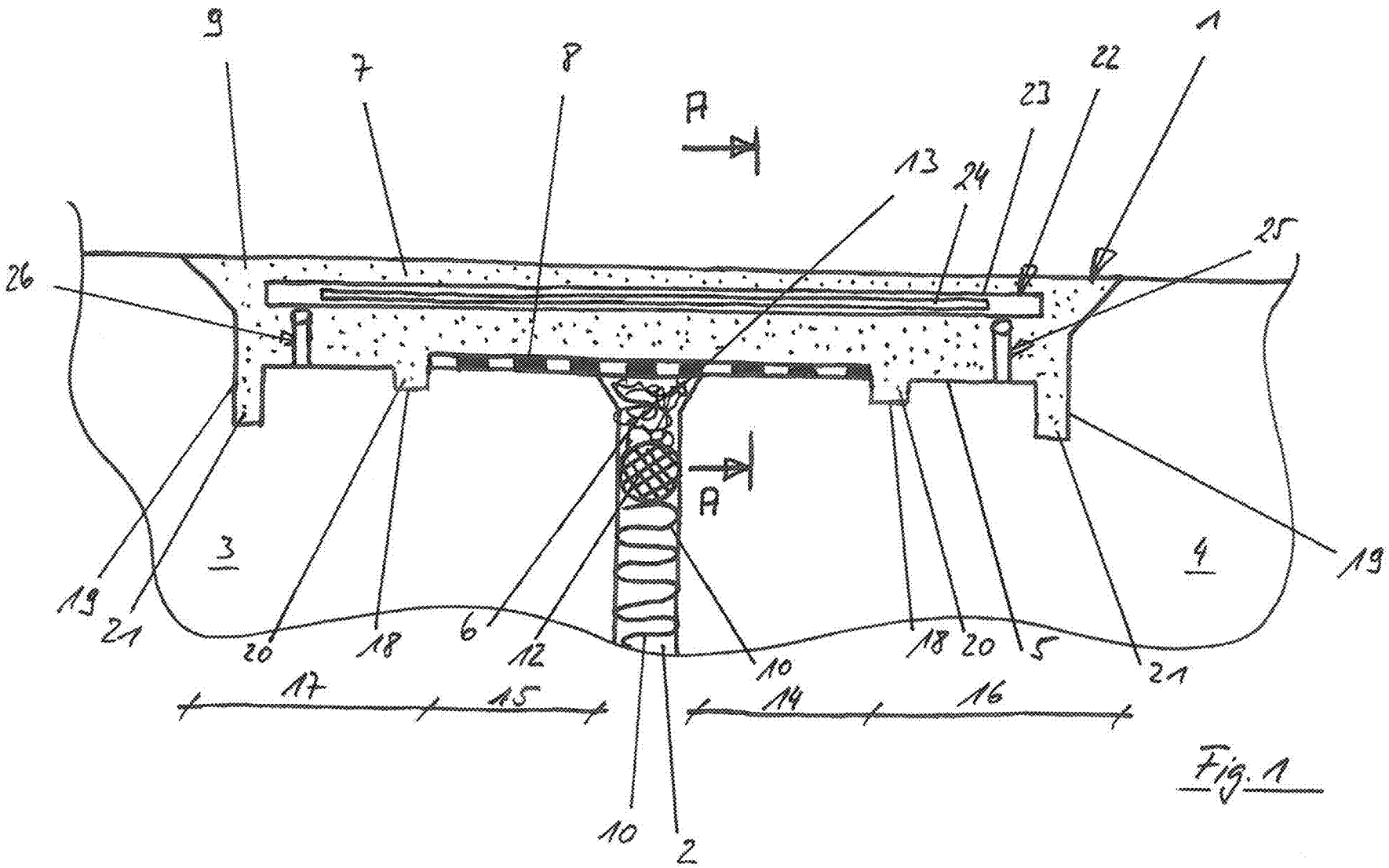
FIG. 1 shows a schematic sectional view of a joint filling profile according to the invention.
Figure 2:
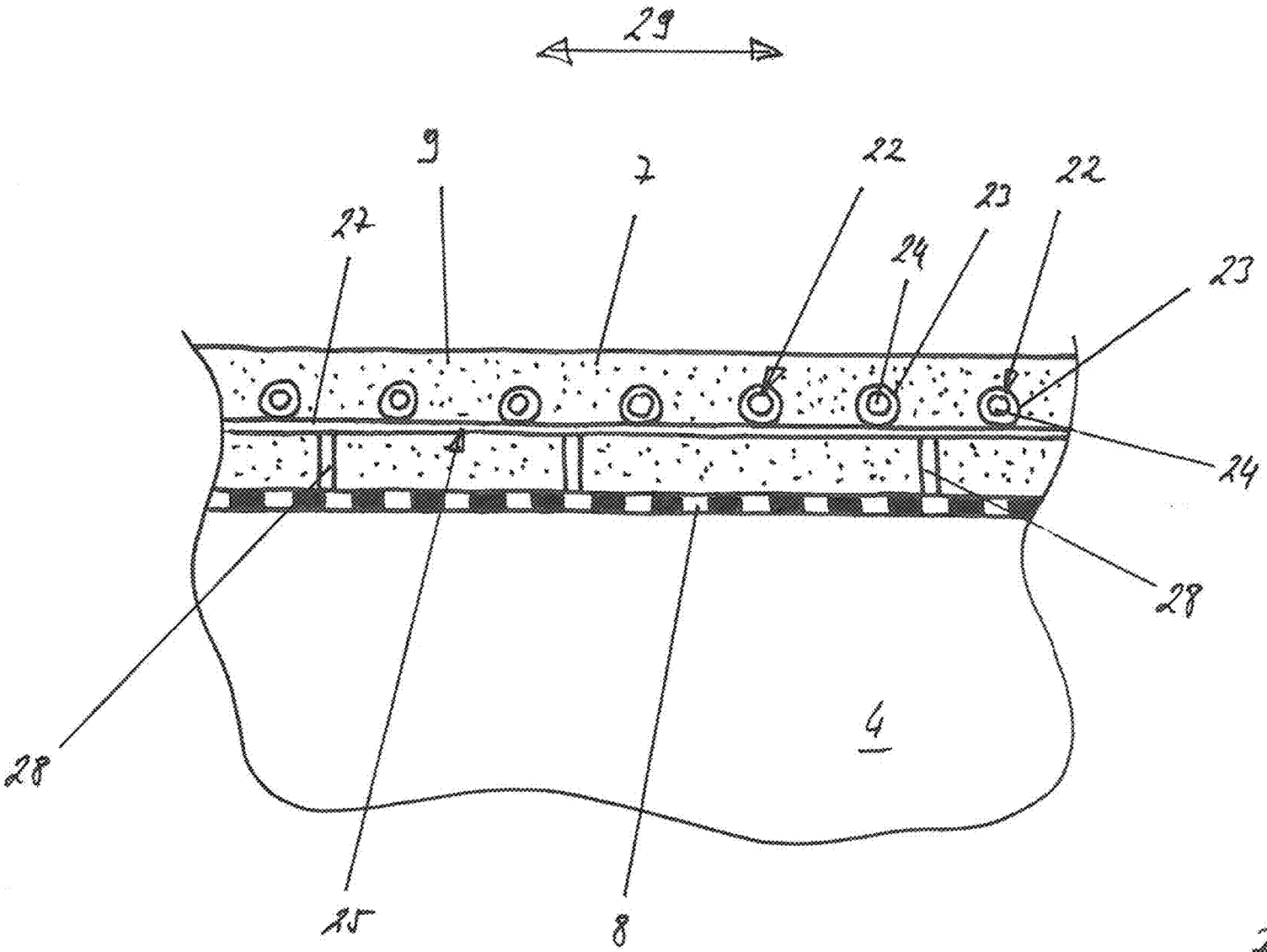
FIG. 2 shows the joint filling profile according to FIG. 1 according to the section line A-A.

FIGS. 1 and 2 show the joint filling profile 1 according to the invention.

As can be seen from the representation according to FIG. 1, in contrast to the state of the art, the vertical leg 6 and the profile body 7 of the joint filling profile 1 are not formed in one piece but are rather separated from each other. This is achieved according to the invention in that a separating material 8 is placed between the vertical leg 6 and the profile body 7. For the separating material 8, the matter can be, for example, of a mechanically operative intermediate layer, for example of a metal foil, in particular of an aluminum foil. In the embodiment that is shown, the profile body 7 is made of a joint sealing compound 9, whereas the vertical leg 6 is formed as a compression block 13 and is made, for example, of an elastic material such as, for example, a foam material. Alternatively, the vertical leg 6 can also be formed of a joint sealing compound 9, in which case preferably the same sealing compound is used for the vertical leg 6 as well as for the profile body 7. But for this case too, it is essential to the invention that the vertical leg 6 and the profile body 7 are separated from each other by means of the separating material 8, thus that there is no direct connection between the profile body 7 and the vertical leg 6.

For each floor panel 3 or 4, the profile body 7 makes available a first portion 14 or 15 adjacent to the joint 2, in which first portion 14 or 15 the profile body 7 bears without any connection on the corresponding floor panel 3 by intercalating a separating material 8. Thus, a continuous area is created that extends over the first portion 15 formed in the area of the floor panel 3, the joint 2 and the first portion 14 formed in the area of the floor panel 4 in which there is no direct connection between the profile body 7 and the underground.

With respect the first portions 14 or 15, the profile body has adjacent second portions 16 or 17. There is, in the area of these portions 16 or 17, a direct connection between the joint sealing compound 9 that forms the profile body 7 and the underground formed by the respective floor panels 3 or 4. For a continuous safe fixing of the profile body 7 into the floor panels 3 and 4, the second portions 16 or 17 have respectively first and second vertical legs 20 and 21 that engage into corresponding grooves 18 and 19 of the floor panels 3 or 4.

Reinforcements in form of dowels 22 are placed inside the profile body 7. This being, a multitude of dowels 22 are provided that are placed the one behind the other in longitudinal direction 29 of the joint 2 as can be seen in particular in the sectional view according to FIG. 2. This being, the dowels 22 are preferably positioned adjacent to each other at equal distances.

Each dowel 22 has a bush 23 and a rod 24 accommodated by the bush 23. This being, as the representation according to FIG. 2 shows, a bush 23 is configured with a longer longitudinal extension than the corresponding rod 24, i.e. the longitudinal extension of the bush 23 exceeds the longitudinal extension of the corresponding rod 24. This configuration makes possible that the rod 24 can slide relative to the bush 23.

In the embodiment that is shown, two spacers 25 and 26 that support the dowel 22 on the one end side or on the other end side serve for placing the dowel 22 in an accurate position inside the joint enlargement 5. This being, each spacer 25 or 26 is made of a bearing element 27, extending in longitudinal direction of the joint 29, that is supported by carrying elements 28, as can be seen in particular from the representation according to FIG. 2.

For forming the joint sealing, the filling material 10 as well as the round cord 12 are first inserted. The formation of the vertical leg 6 then takes place, in the represented embodiment, by inserting a compression block 13 into the joint 2, whereby the joint 2 is filled so as to be flush with the surface of the ground of the joint enlargement 5. The compression block 13 terminates by being flush with the surface of the ground of the joint enlargement 5.

The separating material that extends, in the embodiment that is shown, over the joint 2 and the first two portions 14 and 15 of the floor panels 3 or 4, is then brought in. The spacers 25 and 26 are then positioned inside the joint enlargement 5, spacers on which the dowels 22 are then placed, as shown in FIG. 2. The joint sealing compound 9 is then brought into the joint enlargement 5 for forming the profile body 7, whereby the joint enlargement 5 is filled with the joint sealing compound so as to be flush with the surface of the floor panels 3 and 4.

The advantage of the joint filling profile according to the invention is in particular that it cannot come in the transition area between the profile body 7 and the vertical leg 6 to tearing-off or to crack formations due to different material thicknesses that would later result to undesired detachment phenomena. Furthermore, due to the configuration of the profile body 6 without any connection in the area of the first portions 14 and 15 and of the joint 2, a comparatively big area is created in which the joint filling profile 1 can freely expand for compensating mechanical and/or thermal stresses. Undesired detachment phenomena and/or tearing-off of flanks are thus avoided. This being, the vertical leg 6 does not impede such an expansion activity since, according to the invention, there is no direct connection between the vertical leg 6 and the profile body 7.

In order to avoid bulging in and/or bulging out of the profile body 7 in case of expansion movements, reinforcements in form of dowels 22 are inserted in the profile body 7. This being, the dowels 22 do not counteract or hinder an expansion movement of the joint filling profile 2 since the rods 24 serving as reinforcing elements are placed longitudinally slidable in the corresponding dowels 23 so that a simultaneous movement of the rods 24 is allowed.

The invention claimed is:

1. A joint filling profile for sealing a joint formed between adjacent floor panels comprising:

a vertical leg that projects into said joint and that is formed of a joint sealing compound; and a profile body formed from said joint sealing compound and extending in a joint enlargement wherein the vertical leg and the profile body are separated from each other by intercalating a separating material, which is formed of a metal foil, wherein the profile body has a first portion and a second portion, wherein the first portion is positioned adjacent to the joint and the second portion is positioned adjacent to the first portion, wherein the separating material exclusively extends over the joint and along the first portion, wherein the first portion of the profile body extends over a corresponding floor panel without directly contacting the corresponding floor panel by intercalating the separation material, and wherein the joint sealing compound that forms the second portion of the profile body directly contacts the respective floor panel.

2. The joint filling profile according to claim 1, wherein the profile body has a first vertical web penetrating into a groove of the corresponding floor panel in the second portion adjacent to the first portion.

3. The joint filling profile according to claim 2, wherein the profile body has a second vertical web spaced from the first vertical web in the second portion, this second vertical web penetrating into a groove of the corresponding floor panel.

4. The joint filling profile according to claim 3, wherein both vertical webs limit the second portion.

5. The joint filling profile according to claim 1, wherein a multitude of reinforcements that are placed the one after the other in a longitudinal direction of the joint are embedded into the profile body.

6. The joint filling profile according to claim 5, wherein a reinforcement has a guiding body and a reinforcing element placed slidable relatively thereto.

7. The joint filling profile according to claim 6, wherein the guiding body is a bush.

8. The joint filling profile according to claim 6, wherein the reinforcing element is a rod.

9. The joint filling profile according to claim 6, wherein the rod is accommodated by being longitudinally displaceable by the bush, whereby the bush has a longitudinal extension that exceeds the longitudinal extension of the rod.

10. The joint filling profile according to claim 6, wherein the reinforcement is supported by a first spacer and a second spacer.

11. The joint filling profile according to claim 5, wherein the reinforcement extends into the second portions.

12. The joint filling profile according to claim 1, wherein the profile body is configured axially symmetric and has two first portions adjacent to the joint as well as two second portions, whereby a second portion respectively follows the first portions.

13. The joint filling profile according to claim 12, wherein the separating material extends in the area of the joint and of the two first portions adjacent to the joint.

14. The joint filling profile according to claim 1, wherein the metal foil is an aluminum foil.

15. A joint filling profile for sealing a joint formed between adjacent floor panels comprising:

a vertical leg that projects into said joint and that is formed of a joint sealing compound; and a profile body formed from said joint sealing compound and extending in a joint enlargement wherein the vertical leg and the profile body are separated from each other by intercalating a separating material, which is formed of a metal foil, wherein the metal foil includes a first surface positioned adjacent to one of the floor panels, the profile body engaging a second opposite surface of the metal foil and extending beyond an edge of the metal foil such that a portion of the profile body is positioned adjacent to and configured to directly contact the one of the floor panels.

16. The joint filling profile according to claim 15, wherein the second opposite surface of the metal foil is in contact with the vertical leg.

17. The joint filling profile according to claim 15, wherein the profile body has a first vertical web penetrating into a groove in the corresponding floor panel, the first vertical web extending along the edge of the metal foil.

18. The joint filling profile according to claim 17, wherein the profile body has a second vertical web spaced apart from the first vertical web, the second vertical web penetrating into a groove of the corresponding floor panel, the second vertical web extending along a second opposite edge of the metal foil.

19. A joint filling profile for sealing a joint formed between adjacent floor panels comprising:

a vertical leg that projects into said joint and that is formed of a joint sealing compound; and a profile body formed from said joint sealing compound and extending in a joint enlargement wherein the vertical leg and the profile body are separated from each other by intercalating a separating material, which is formed of a metal foil, wherein the profile body is configured axially symmetric and has two first portions adjacent to the joint as well as two second portions, whereby a second portion respectively follows the first portions, wherein the separating material exclusively extends in an area of the joint and an area of the two first portions, wherein the first portions of the profile body bear on the corresponding floor panels without any connection by intercalating the separation material, and wherein in the area of the second portions of the profile body a direct connection is formed between the joint sealing compound that forms the profile body and the respective floor panels, wherein a multitude of reinforcements that are placed one after the other in a longitudinal direction of the joint are embedded into the profile body, wherein the reinforcements are supported by a first spacer and a second spacer, wherein the first spacer is positioned in one of the second portions and wherein the second spacer is positioned in the other of the second portions.

* * * * *